United States Patent [19]

Ögren

[11] 4,240,661

[45] Dec. 23, 1980

[54] YOKE

[75] Inventor: Hans Ögren, Kristinehamn, Sweden

[73] Assignee: Aktiebolaget Ögrens Svets-och Mek. Verkstad, Kristinehamn, Sweden

[21] Appl. No.: 17,855

[22] Filed: Mar. 6, 1979

[51] Int. Cl.[3] ..... B66C 1/34

[52] U.S. Cl. ..... 294/82 AH; 414/563

[58] Field of Search ..... 294/82 AH, 82 R; 280/292, 402, 490 A, 493, 503, 481; 414/563, 611, 619, 620, 621, 668, 785

[56] References Cited

U.S. PATENT DOCUMENTS

| | | | |
|---|---|---|---|
| 1,520,194 | 12/1924 | Matthews | 414/563 |
| 4,049,140 | 9/1977 | Roosp | 414/621 |

FOREIGN PATENT DOCUMENTS

| | | |
|---|---|---|
| 105962 | 11/1898 | Fed. Rep. of Germany . |
| 633744 | 2/1928 | France . |
| 809070 | 2/1937 | France . |
| 63448 | 3/1925 | Sweden . |
| 111581 | 8/1944 | Sweden . |

*Primary Examiner*—James B. Marbert

*Attorney, Agent, or Firm*—Murray and Whisenhunt

[57] ABSTRACT

Yoke particularly for lifting motor-cars by applying lifting forks under an axle or other suitable lifting point of the car and thereafter pushing the yoke upwards. The yoke has two end portions each designed as an open box formed of two longitudinal vertical side plates and at least one vertical end plate. A sleeve for journaling a shaft bar extends through each end portion and has an outer diameter which is somewhat smaller than the distance between the vertical side plates, so that the sleeve may be longitudinally displaced within the open box between two end positions and may be securably adjusted in different positions between the two end positions.

5 Claims, 5 Drawing Figures

YOKE

The present invention relates to a yoke designed in each end to be provided with an up-right lifting fork or other support for the object to be lifted, particularly a yoke for lifting motor-cars by applying the lifting forks under an axle of the car or under other suitable lifting point and thereafter pushing the yoke upwards.

Yokes for lifting motor-cars are well known in the art and are commonly used on breakdown lorries for front axle lifts. In order to make it possible to utilize one and same yoke for salvaging cars having different axle dimensions and axle designs it is necessary that the distance between the lifting forks can be adapted to the design of the car in the region of the axle. To that purpose yokes for lifting motor-cars hitherto used are provided with a plurality of fixed sleeves in each end portion of the yoke. By choosing a proper pair of sleeves it is therefore possible to a certain extent to adapt the distance between the forks to the circumstances.

It is an object of this invention to improve the possibilities of more accurately arriving at a desired distance between the forks. It is a second objective to adjust the distance between the forks without having to take out the forks from their respective sleeve, which would bring about a possibility to adjust the distance also when the yoke is placed under the car which shall be lifted. Another object is to offer a yoke which is easy to handle but which nevertheless satisfies high demands as to reliability. Further it is an object to offer a yoke provided to resist high strains in the region of the forks because of the heaviness of the car.

Further objects and advantages of the invention will be apparent from the following description of a preferred embodiment. Herein it will be referred to the accompanying drawings in which FIG. 1 is a side-view illustrating yoke according to the preferred embodiment, as well as a pair of associated lifting forks shown by dashed lines.

Figure 1:
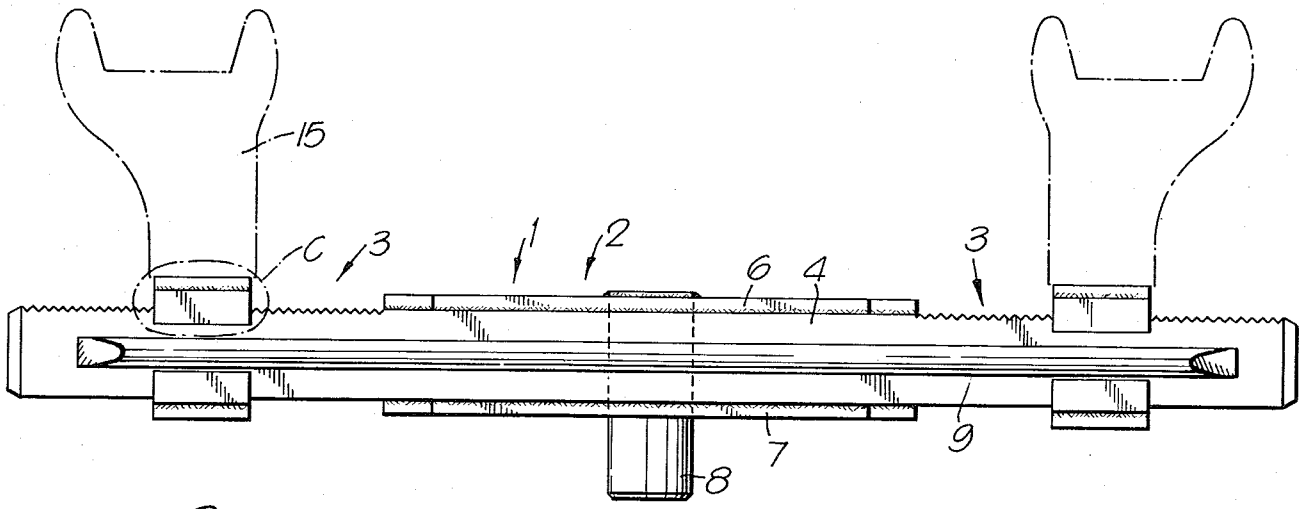
Figure 2:
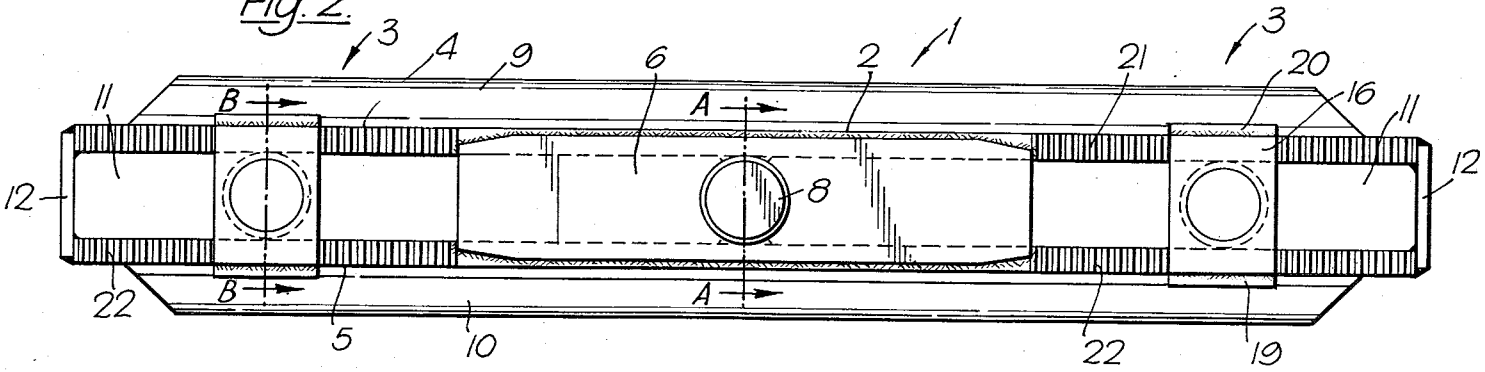
FIG. 2 is a top-view showing the same yoke without lifting forks.
Figure 3:
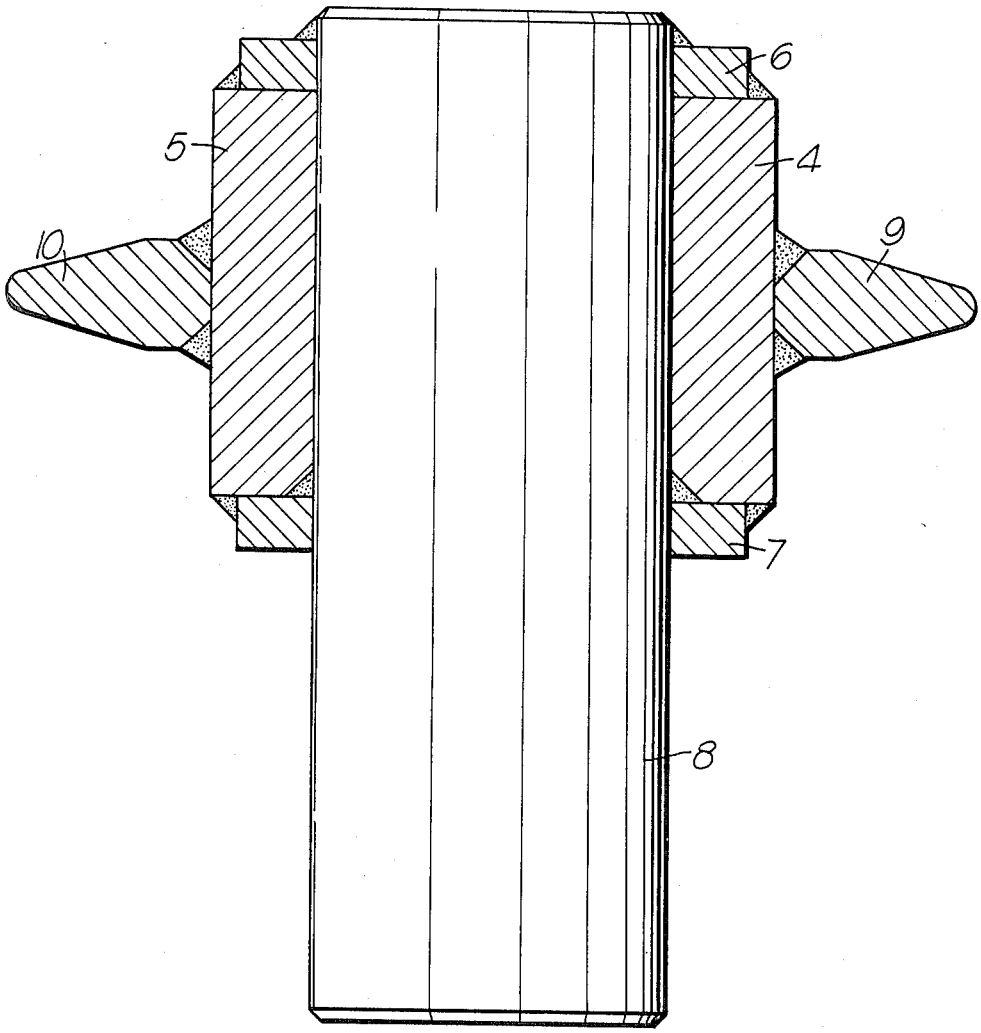
FIG. 3 is a section A—A in FIG. 2 at a larger scale.

Referring first to FIG. 1 and FIG. 2 a yoke is generally shown as 1. The yoke 1 according to the selected embodiment has a straight configuration including a central portion 2 and identically designed end portions 3. Along the entire length of the yoke there extend two vertical, parallel side plates 4 and 5. The central portion 2 consists of a welded box which is open in its ends, said box being defined by the two side plates 4 and 5 and an upper and a lower cover plate 6 and 7 respectively. The cover plates 6 and 7 serve to make the yoke rigid and to prevent it from being deformed in the region of the central portion 2. Through the latter there extends a vertical shaft journal 8 provided to be connected to a lifting device which is not shown in the drawings. In order to make the construction more rigid there are further profile bars 9 and 10 welded to each side plate 4 and 5 respectively.

Figure 4:
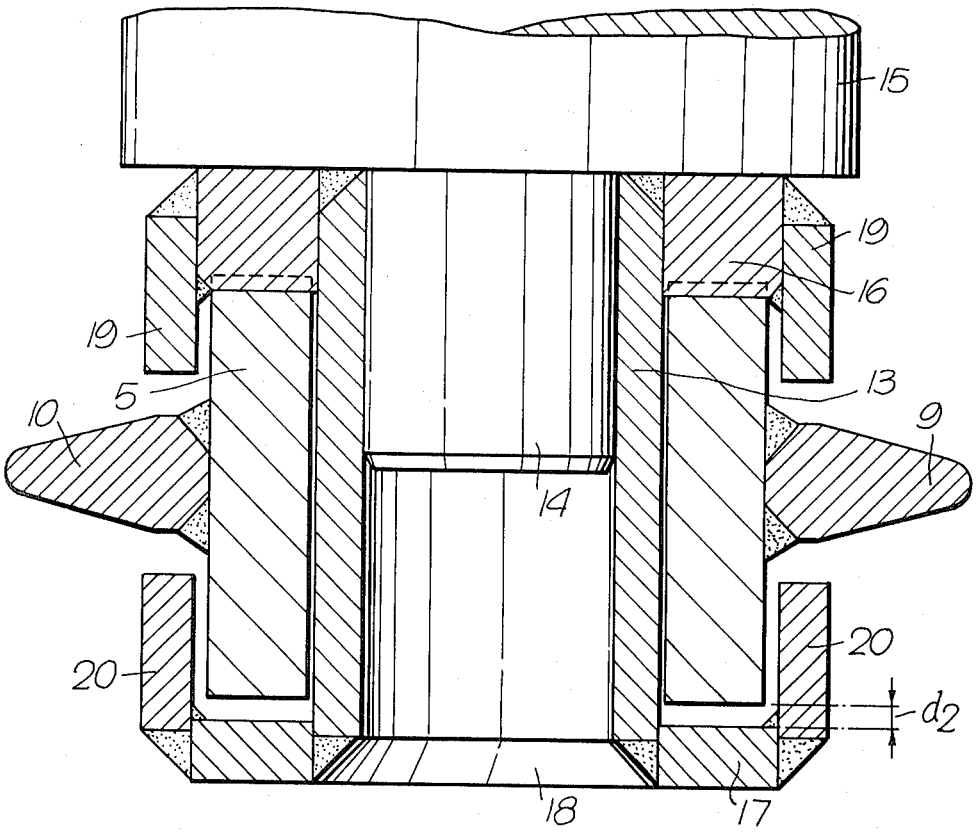
FIG. 4 is a section B—B in FIG. 2 at the same scale.

Each end portion 3 has the form of an elongated box 11 without cover or bottom. The boxes 11 terminate in their outer ends by an end plate 12. In each of the open boxes 11 there is provided a sleeve 13, FIG. 4, the outer diameter of which is slightly smaller than the distance between the side plates 4 and 5. The sleeve 13 therefore can be displaced in the box 11 between the end plate 12 and the edge of the cover plates 6 and 7 of the central portion 2. The inner diameter of the sleeve 13 is selected such that a shaft journal 14 of a lifting fork 15 can be journaled in the sleeve.

The possibilities of displacing the sleeve 13 in the vertical direction is restricted by the fact that the sleeve 13 in its upper end is connected to a rectangular plate 16 with a throughboring for the sleeve 13, and by the fact that the sleeve in its lower end is connected to an equally large rectangular plate 17. The plates 16 and 17 extend past the outer surfaces of the side plates 4 and 5. The sleeve 13 in other words is locked in in the open box 11 by means of the plates 16 and 17. The lower plate 17 is provided with a central opening 18 serving as a drainage hole. In order to prevent the side plates 4 and 5 from being buckled or in any other way deformed due to the heaviness which e.g. a motor-car may exert upon the side plates 4 and 5 via the lifting forkes 15 the upper and lower plates 16 and 17 on outside of the side plates 4 and 5 are provided with catch plates 19 and 20, respectively. The catch plates 19 and 20, which extend downwards from the upper plate 16, and upwards from the lower plate 17, respectively, thus serve to prevent the side plates 4 and 5 from being out-buckled under the exertion of a heavy load.

Figure 5:
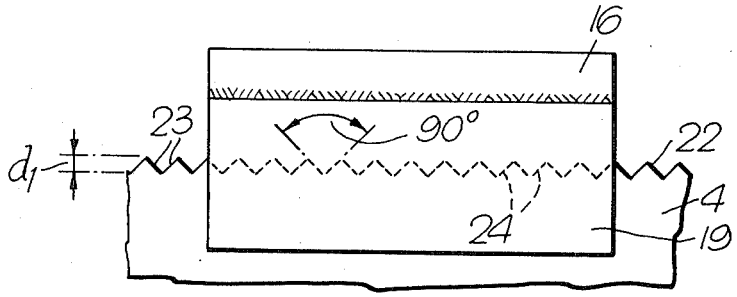
FIG. 5 shows in the same scale the portion C encircled in FIG. 1, corresponding to a portion of a view C—C in FIG. 2 (the lifting fork not being shown).

Referring now also to FIG. 5 the upper edges 21 and 22 of the side plates 4 and 5, respectively, are provided with grooves in the region of the end portions 3. More particularly the upper edges 21 and 22 have been made saw toothed. According to the selected embodiment the teeth, which are designated 23, have been given right angles, FIG. 5. The tooth height has been designated $d_1$. The under side of the plate 16 has been provided with teeth 24 having the same shape and size as the teeth 23 so that the plate 16 by being lowered towards the side plates 4 and 5 may be secured in the adopted position.

The distance $d_2$ between the lower edge of the side plates 4 and 5 and the lower plate 17 is slightly, which means about 2–5 mm, larger than the tooth height $d_1$. By pushing the plate 17 to a maximal fit-up against the lower edge of the side plates 4 and 5 it is thus possible to release the teeth 24 of the plate 16 from their contact with the teeth 23 of the side plates 4 and 5. Thereafter—but not before—the sleeve 13 may be displaced in the box 11 from one position to another. This effectively prevents the sleeves 13 and the lifting forks 15 provided in the sleeves from involuntarily changing their position.

I claim:

1. Yoke designed in each end to be provided with an up-right lifting fork or other support for an object to be lifted, particularly a yoke for lifting motor-cars by applying the lifting forks under an axle of the car or under other suitable lifting point and thereafter pushing the yoke upwards, characterized in that the yoke has two end portions in each of which is provided a sleeve for journaling a shaft bar of said lifting fork or corresponding support, each end portion being designed as an open box formed of two longitudinal, vertical side plates and at least one vertical end plate, said sleeve extending through said open box and having an outer diameter which is somewhat smaller than the distance between the vertical side plates, so that the sleeve may be displaced in the box between two end positions, said sleeve being securably adjustable in different positions between the end positions.

2. Yoke according to claim 1, characterized in an upper plate secured to the sleeve and having a through hole for the sleeve and/or for said shaft bar, and a lower plate secured to the sleeve.

3. Yoke according to claim 12, characterized in that at least one of said upper and lower plates extends past the outer surface of the vertical side plates which define said open box, and that from said at least one of said upper and lower plates there extends a pair of catching plates over said vertical side plates so that an out-buckling of said vertical side plates because of the load upon the yoke is prevented.

4. Yoke according to claim 3, characterized in that said upper and said lower plates are provided with catching plates extending over the vertical side plates.

5. Yoke according to any of claims 1-4, characterized in that an upper edge of each of the vertical side plates and a lower side of the upper plate are provided with cooperating teeth and grooves, and that a lower edge of the vertical side plates is separated from the lower plate by a distance which is somewhat larger than the depth of the grooves, making it possible to release the upper plate from its engagement with the upper edges of the side plates by raising the sleeve within the box so that the lower plate is pressed against the lower edges of the side plates, whereupon the teeth and grooves are disengaged and the sleeve may be displaced to any position in the box and secured in that position by thereafter being relowered to reengage the teeth and grooves.

* * * * *